United States Patent [19]

Hardt

[11] Patent Number: 4,899,659

[45] Date of Patent: Feb. 13, 1990

[54] SAFE AND ARM DEVICE

[75] Inventor: Lee R. Hardt, Ridgecrest, Calif.

[73] Assignee: The United States of America as represented by the Secretary of the Navy, Washington, D.C.

[21] Appl. No.: 374,038

[22] Filed: Jun. 30, 1989

[51] Int. Cl.[4] ..... F42C 15/24; F42C 15/32; F42C 15/36

[52] U.S. Cl. ..... 102/229; 102/251; 102/263

[58] Field of Search ..... 102/221, 222, 223, 228, 102/229, 247, 251, 262, 263

[56] References Cited

U.S. PATENT DOCUMENTS

| | | | |
|---|---|---|---|
| 4,099,466 | 11/1978 | Redmond et al. | 102/215 |
| 4,188,886 | 2/1980 | Brauer et al. | 102/223 |
| 4,202,271 | 5/1980 | Day | 102/247 |
| 4,359,942 | 11/1982 | Schmidlin | 102/263 |
| 4,380,197 | 4/1983 | Eaton | 343/701 |
| 4,489,656 | 12/1984 | Hennings et al. | 102/254 |
| 4,526,104 | 7/1985 | Brauer et al. | 102/228 |
| 4,691,634 | 9/1987 | Titus et al. | 102/229 |
| 4,739,705 | 4/1988 | Hudson et al. | 102/222 |

*Primary Examiner*—David H. Brown

*Attorney, Agent, or Firm*—Sol Sheinbein; Melvin J. Sliwka; Harvey A. Gilbert

[57] ABSTRACT

A safe and arm device having a bellows motor-driven rotor bearing a detonator. When the device is in the SAFE condition the detonator is shrouded by an airpot piston extending from one end of a spring secured within the airpot cylinder in the housing. The airpot piston compresses the spring in response to weapon acceleration until the piston fully resides in the airpot cylinder in the device housing. The rotor is thus free to be rotated overriding a detent maintaining the SAFE condition by the action of the bellows motor which is electrically activated. The rotor turns until it reaches the "ARMED" position where the detonator therein is positioned directly in line with weapon's warhead explosive trigger charge in the housing. The rotor is rotationally secured relative to the housing in the "ARMED" position by the action of another detent.

18 Claims, 2 Drawing Sheets

FIG. 1.
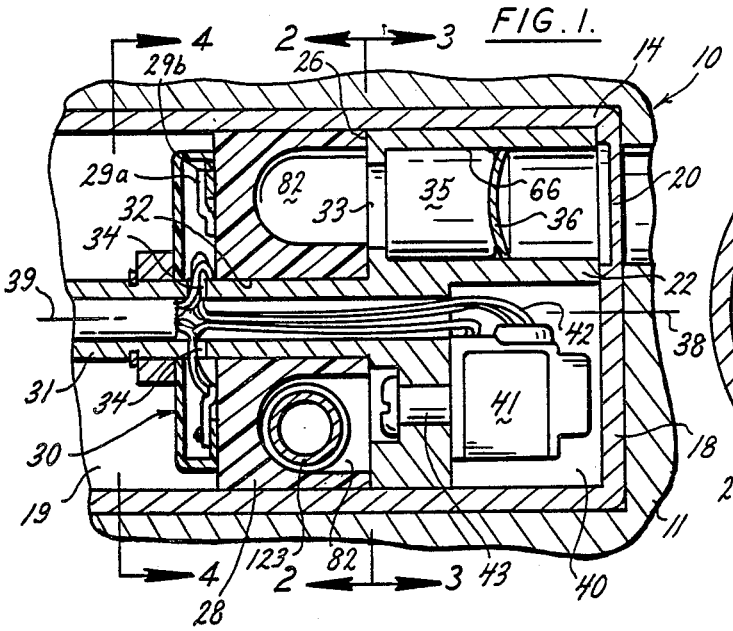
FIG. 4.
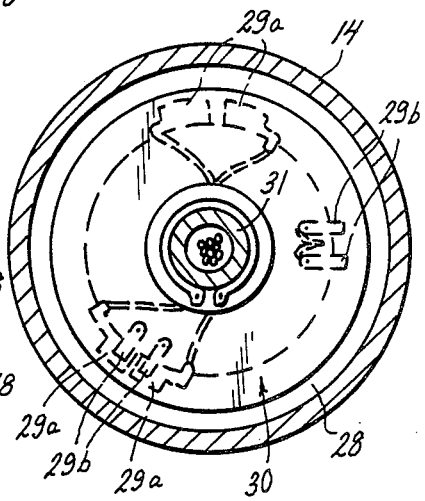
FIG. 2.
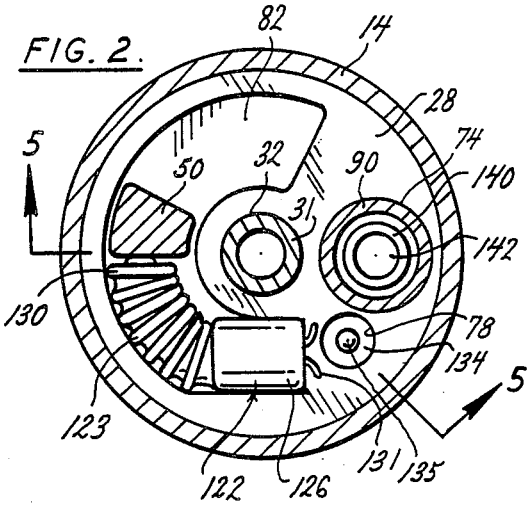
FIG. 3.
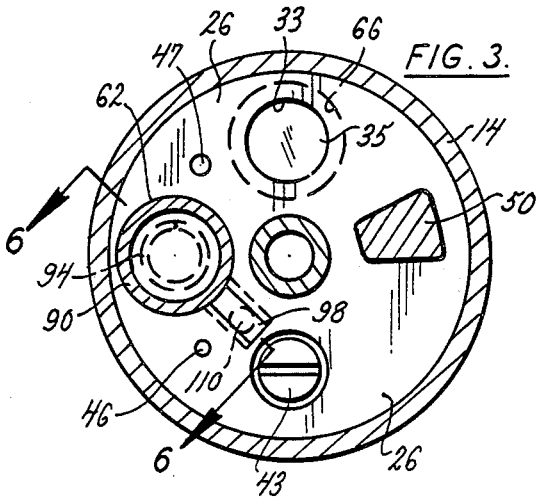
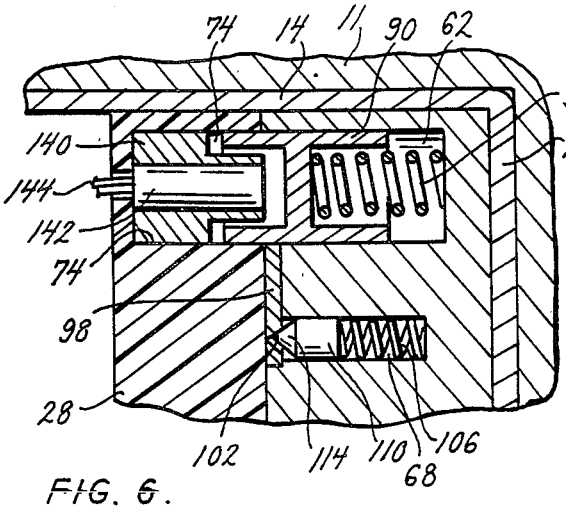
FIG. 6.
FIG. 5.
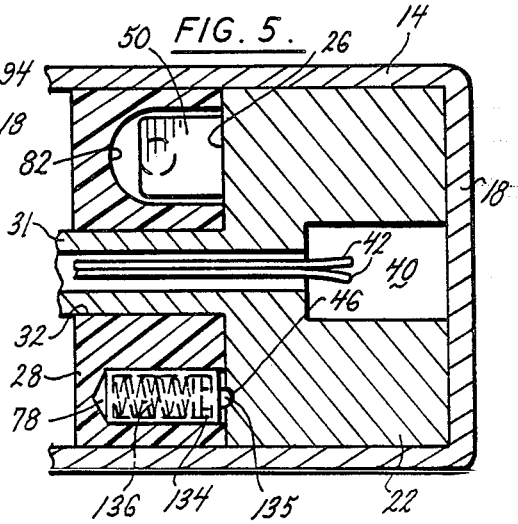

FIG. 7.
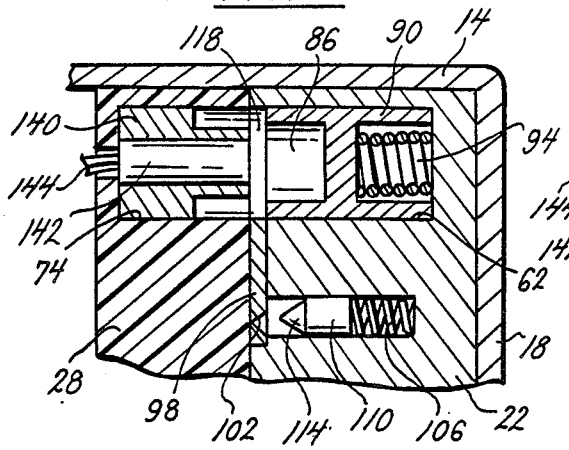
FIG. 8.
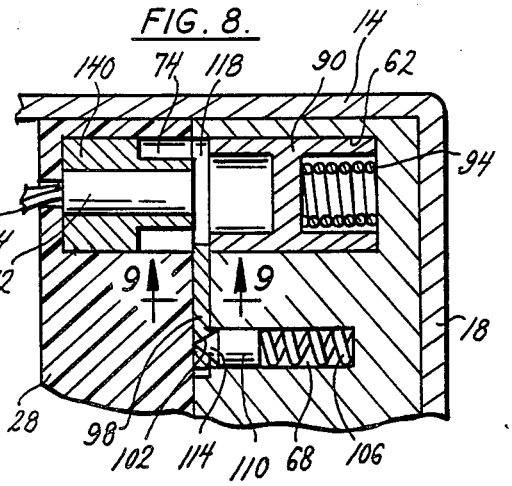
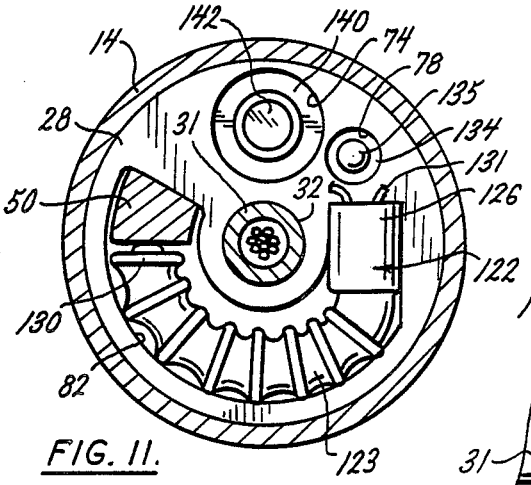
FIG. 11.
FIG. 10.
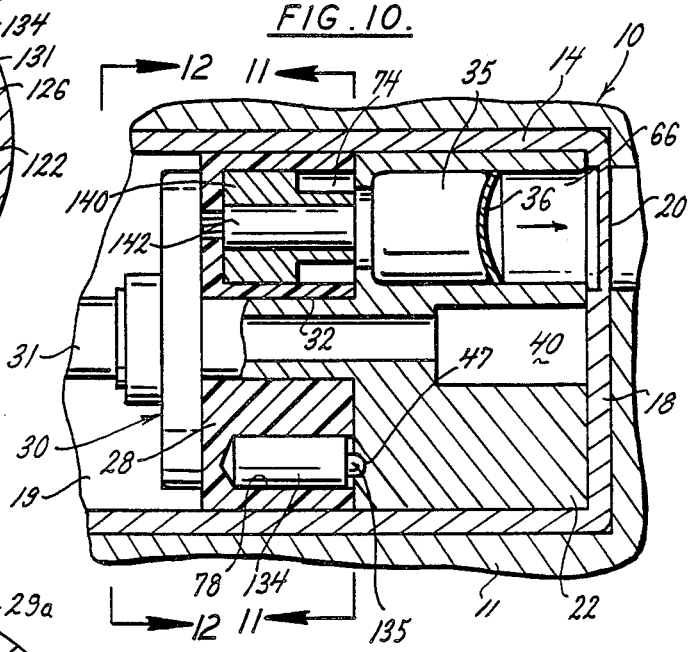
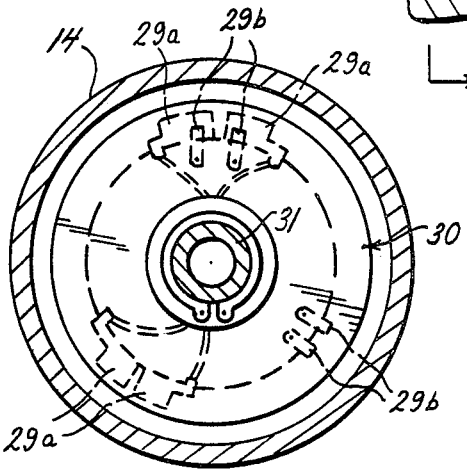
FIG. 12.
FIG. 9.
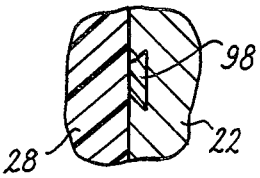

SAFE AND ARM DEVICE

BACKGROUND OF THE INVENTION

The present invention relates to air or ground launched weapons and more particularly to the means for making and maintaining such weapons safe and then arming them in relation to their operating environment at a specific time during use.

In the handling of explosive ordnance it is important that steps be taken to assure that the ordnance is incapable of being armed and exploded inadvertently or accidentally under all circumstances of handling and transport prior to use as intended at a controlled point in time.

A variety of means for safing and arming such ordnance is known to those who are skilled in their use. In general, it is desirable to control all electrical, mechanical, optical or other inputs to explosive ordnance so that their individual, combined and sequenced interactions maintain the ordnance SAFE unless and until the exact criteria for and conditions precedent to obtaining the desired explosive result obtain.

One common approach to safe and arming an ordnance device employs a movable barrier between each functional component in the firing chain in order to interrupt the flow of critical firing events until the required time. A second and more commonly used scheme involves misalignment of explosive elements within the safe and arm device until the required time when proper alignment and receipt of firing and related signals must occur to create the "ARMED" device.

In addition to the factors addressed by the two above approaches to the general safe-arm problem, ordnance launch from the ground or an aircraft introduces additional factors which must be considered. Obviously, it is imperative from the standpoint of personnel, aircraft, and support or launch facility safety that ordnance or weapons remain in a "SAFE" condition under all prelaunch storage, handling, and operational circumstances. Ideally, the safe-arm device should be functionally and physically organized to eliminate the threat of unintentional arming resulting from environmental influences prior to weapon launch to a target. If for any reason the explosive elements within the safe-arm device were to explode prior to operational weapon deployment, the safe-arm device should be able to contain the explosion and prevent communication of its effects to the other charges within the safe-arm device which are precursor ignitors for the booster or warhead explosives.

It is well known to those skilled in the field of ordnance operations that use of either electrical, electronic, or mechanical means to provide timing delays necessary for safe separation and arming functions perform with varying degrees of reliability. In fact, there are pros and cons to the use of each means individually so that it has been found in the prior art that combination of these means can provide the best performance functionally and reliably.

SUMMARY OF THE INVENTION

It is thus an object of the present invention to provide a safe and arm device that is functionally and operationally simple and reliable.

It is still another object of the present invention to provide a safe and arm device requiring a combination of events in sequence to change the apparatus from its SAFE to its ARMED mode.

It is yet another object of the present invention to physically separate the explosive elements of a safe and arm device until such time as functional arming of the device is sequentially set in motion.

It is further an object of the present invention to provide a safe and arm apparatus that provides an arming delay dependent upon a variable factor such as acceleration only existent in the operational environment.

It is another object of the present invention to provide a safe and arm apparatus that can only be changed from the SAFE to the ARMED mode by a sequence of actions triggered during employment in the operational environment by the effects of that environment on the apparatus.

The present invention satisfies the recited objects by physically separating explosive elements within the SAFE and ARM device and requiring operational environment effects to actuate the device. Shipping, ground handling, storage, and preflight and flight activities prior to weapon release are incapable of actuating the present invention. The physical separation and displacement of explosive elements is related to an electrical switch which is thus unable to supply explosive ignition signals until the explosive elements of the device have been physically repositioned by a chain of events triggered by the effects of the operating environment.

Specifically, the SAFE and ARM device of the present invention has a housing which has a fixed base containing a spring-biased airpot, and a shaped-charge and impact plate separated angularly from the airpot in receptacles extending longitudinally from the interior towards the end of the device in which the base resides. A boss extends normally from the interior directed face of the base. A cylindrical rotor having a longitudinally oriented first receptacle and a diametrically opposed arcuate channel-like receptacle extending inward from the rotor surface facing the interior directed face of the base is located rotably in close association with the base on a central shaft extending longitudinally from the center of the base through the device. The rotor first receptacle contains the detonator which is ultimately used to detonate the explosive chain to the weapon warhead. In the SAFE mode the airpot cylinder extends from the base into the rotor first receptacle to shroud the detonator and lock the rotor from rotational movement relative to the base. The arcuate channel-like receptacle contains an explosively activated bellows motor which in the SAFE mode of the device abuts the boss extending into the channel-like receptacle from the adjacent base surface. In the SAFE mode, the device of the present invention thus locks the rotor from movement and simultaneously keeps the detonator shrouded and located angularly away from the explosives in the base which are otherwise in the explosive chain to the warhead. Thus, if the detonator was to explode unexpectedly while shrouded, the explosive force and by products would be contained and removed from other device explosives. A rotary switch, one side of which is located on the shaft from the base through the rotor and the other side of which is located on the rotor communicates electrical signals from an electronics and power box to the ignition circuits of the device. In operation, only acceleration at the appropriate point during weapon ascent can cause the airpot to move out of the first receptacle in the rotor and retract into the base so that the bellows motor can push against the boss causing the rotor to be turned relative to the base on receipt of the required motor electrical signal. The rotor turns until the detonator in the rotor is in direct alignment with the explosive charge in the base at which point a detonator signal from the weapon electronics can initiate the explosive chain to the warhead.

The above described objects and the details by which the present invention addresses those objects will be more fully and clearly understood upon consideration of the drawings, their descriptions and the detailed discussion of the invention and its operation which follow.

DESCRIPTION OF THE DRAWINGS

FIG. 1 is a longitudinal cross-section view of the Safe-Arm device within a weapon structure.

FIG. 2 is a lateral cross-section view taken along line 2—2 of FIG. 1 looking at the rotor of the invention in the "SAFE" condition.

FIG. 3 is a lateral cross-section view taken along line 3—3 of FIG. 1.

FIG. 4 is a lateral cross-section view taken along line 4—4 of FIG. 1.

FIG. 5 is a longitudinal partial cross-section view taken along line 5—5 of FIG. 2 prior to weapon acceleration and with the invention in the "SAFE" condition.

FIG. 6 is a longitudinal partial cross-section view taken along line 6—6 of FIG. 3 prior to weapon acceleration and with the invention in the "SAFE" condition.

FIG. 7 is a longitudinal cross-section view as in FIG. 6 during weapon acceleration and the invention transitioning between the "SAFE" and "ARMED" conditions FIG. 8 is a longitudinal cross-section view as in FIGS. 6 and 7 after weapon acceleration and with the invention in the "ARMED" CONDITION.

FIG. 9 is a cross-section view taken along line 9—9 in FIG. 8.

FIG. 10 is a longitudinal cross-section view similar to FIG. 5 when the invention is in the "ARMED" condition.

FIG. 11 is a lateral cross-section view similar to FIG. 2 except that the invention is now shown in the "ARMED" condition.

FIG. 12 is a lateral cross-section view similar to FIG. 4 except that the invention is now shown in the "ARMED" condition.

DETAILED DESCRIPTION

The present invention as depicted in FIG. 1 is a safe and arm device 10 typically borne in a weapon structure 11 in which the booster and warhead explosives will be found to the right and the power and control electrical signals to the left of the components shown. The safe and arm device 10 consists of the housing 14 which has a base end 18 to the right and an electronics end 19 to the left in FIG. 1. The housing 14 contains the fixed base 22 which extends from the base end 18 of the housing 14 to the intermediate surface 26. The base end 18 of the fixed base 22 has a window 20 which aligns with a booster explosive in the warhead section of the weapon with which the SAFE and ARM device abuts. Immediately to the left of the intermediate surface 26 in FIG. 1 the rotor 28 is visible. To the left of the rotor 28 the rotary switch 30 is shown. Both the rotor 28 and the rotary switch 30 are mounted upon the tubular shaft 31 which extends from the fixed base 22 through the centrally located cylindrical hole 32 in the rotor 28 and the center of rotary switch 30. It should be noted that the rotor contacts **29*a* which are affixed to the rotor 28 are shown in one 10 contacting relationship with the switch contacts 29*b* of the rotary switch 30 which is itself immovably affixed to tubular shaft 31. The longitudinal axis 38 of the housing 14 is coincident with the longitudinal axis 39 of the tubular shaft 31 extending from the intermediate surface 26 of the fixed base 22, as seen in FIG. 1. These axes pass through the center of the cylindrical hole 32 in the rotor 28 and the center of the juxtaposed rotary switch 30**.

Within the fixed base 22 at the right of the housing 14 in FIG. 1, the opening 33 extends from the intermediate surface 26 to the second cylindrical receptacle 66. The shaped charge 35 is located within the second cylindrical receptacle 66 between the opening 33 and the curved impact plate 36. The curved impact plate 36 is friction fit within the second cylindrical receptacle 66 at an intermediate point therein and to the left of the window 20 at the base end 18 of the housing 14. A prepackaged form of the shaped charge 35 and the curved impact plate 36 is known as the flying plate lead. It consists of an aluminum cup containing the shaped charge 35 and is closed at its otherwise open end by a steel impact plate 36. This prepackaged means for exploding an external booster explosive is simply fitted within the second cylindrical receptacle 66 and cemented therein, if necessary.

The more detailed functional features of the rotor 28 and the fixed base 22 of the safe and arm device 10 will now be discussed with reference to FIGS. 1, 2, and 3. In particular FIGS. 2 and 3 depict the functional components of the safe and arm device 10 when they are in the SAFE condition. Referring to FIG. 1 it should be understood that the window 20 is always in alignment wit the booster explosive charge which is next in line to the right of window 20 and immediately adjacent to and in contact with the warhead explosive in the warhead section of the weapon. The safe and arm device of the present invention must be installed so that this relationship exists. In order to exclude outside contaminants from the safe and arm device 10 the window 20 is not a direct opening to the outside of the device. It is, in the preferred embodiment, a thinned section of the base end 18 of the housing 14. The thickness of the window 20 is dependent upon the type of shaped charge 35 and curved impact plate 36 used. Using a typical flying plate lead, either prepackaged, as discussed above or assembled in place, a receptacle exit velocity of the curved impact plate 36 would be approximately 10,000 feet per second on contact with the window 20. There is little energy loss by the curved impact plate 36 as it passes through the window 20 to degrade its impact effect required to detonate the booster explosive. Also shown in FIG. 1, the fixed base 22 contains the compartment 40 which accommodates the trembler switch 41, the leads 42 for which extend down the center of the tubular shaft 31 on their wa to the rotary switch 30. The trembler switch 41, which is affixed securely to the fixed base 22 by means of the screw 43, is a backup impact switch which sets off the warhead explosives on weapon impact with the target if the target proximity detection devices in the weapon fail to send the appropriate signal to the safe and arm device 10. The leads 42 from the trembler switch 41 extend through the slots 34 in the tubular shaft 31 to switch contacts **29*b* of the rotary switch 30 where they connect with the weapon system electronics when the safe and arm device 10 is in the ARMED mode. In FIG. 3 the second cylindrical receptacle 66 is again shown in order to view its position relative to the first cylindrical receptacle 6 also shown in FIG. 3. These two receptacles are shown displaced 90 degrees angularly from each other for this preferred embodiment. Other angular displacements can be used as applications dictate. The object of the displacement is, of course, ultimately to secure the elements of the explosive train in the weapon which reside in the rotor 28 and the fixed base 22 separated in the SAFE mode and bring them in juxtapositional alignment in the ARMED mode of the device. This will be further discussed in more detail hereinafter. Continuing in FIG. 3, the boss 50 extends normal to the Figure from the intermediate surface 26. The shallow dimple 46 and the deep dimple 47 which extend inward in the figure into the intermediate surface 26 are shown also displaced radially 90 degrees from each other. Also shown in FIG. 3 is another view of the screw 43 which extends through a portion of the fixed base 22 to hold the trembler switch 41 within the compartment 40 of the fixed base 22**.

Further, in FIGS. 1 and 2, it can be seen that the rotor 28 contains the channel-like receptacle 82 which houses the bellows motor 122. FIG. 2 shows the bellows motor 122 in the Safe condition of the safe and arm device 10. The bellows 123 is shown in its unextended condition with its immobile end 126 immovably affixed at one end of the channel-like receptacle 82 and its mobile end 130 at an intermediate position in the channel-like receptacle 82 abutting the boss 50 which extends upward from the intermediate surface 26 of the fixed base 2 into the channel-like receptacle 82 of the rotor 28. A view of the face of the boss 50 in contact with the nub 52 centered on the mobile end 130 of the bellows 123 seen in FIG. 2 reveals it to be a radial planar surface when FIG. 2 is viewed with FIG. 5. The leads 131 of the bellows motor 122, shown in FIG. 2, bring an ignition signal through the rotary switch 30 from the weapon electronics. The first signal received during the arming phase sets off a charge in the immobile end 126 of the bellows 123 to produce the gas required for its expansion. In FIG. 2 the first receptacle 74 of the rotor 28 is shown with the detonator holder 140 which contains the detonator 142 located therein. FIGS. 6, 7, and 8 further depict and clarify the arrangement of the detonator holder 140 and the detonator 142, with its signal wires 144, within the last receptacle 74 of the rotor 28. FIG. 2 also shows the second receptacle 78 in the rotor 28 in which the detent 134 movably resides.

The relationship of the airpot piston 90 extending from the fixed base 22 into the rotor 28 is shown in FIG. 6. The airpot piston 90 which extends from one end of the spring 94, the other end of which is affixed to the closed end of the first cylindrical receptacle 62 in the fixed base 22, is shown extending about and thus shrouding the detonator 142 within the first receptacle 74 of the rotor 28 when the safe and arm device 10 is in its SAFE condition. The slider plate 98 shown in FIGS. 3 and 6 is movably constrained in the slot 118 shown in FIG. 7 and 8 and abuts the airpot piston 90 when the safe and arm device 10 is in its SAFE condition. In FIG. 6 it can be seen that the upper portion of the cam surface 114 of the piston 110 is in contact with the cam surface 102 of the slider plate 98 which is proximate to the intermediate surface 26 when it is in direct contact with the airpot piston 90 in its extended condition across the intermediate surface 26 and into the first receptacle 74 of the rotor 28. The spring 106 connects the piston 110 to the closed end of the third cylindrical receptacle 68 within the fixed base 22. The piston-shaped detent 134 shown in FIG. 2 is also shown in FIG. 5 where the detent 134 is in the second receptacle 78 of the rotor 28 and contains the detent spring 136 which forces the nub 135 at the end of the piston facing the intermediate surface 26 of the fixed base 22 into either the shallow dimple 46 or the deep dimple 47 in the intermediate surface 26. In FIG. 5 the safe and arm device 10 is in the SAFE position and therefore the nub 135 is in the shallow dimple 46. When the safe and arm device 10 is caused to move to the ARMED condition the nub 135 will come to a rest in the deep dimple 47, as seen in FIG. 10. FIG. 7 further shows the position of the piston 110 relative to the slider plate 98 during weapon acceleration as the arming process is underway and FIG. 8 shows the cam surface 114 of the piston 110 in full contact with the cam surface 102 of the slider plate 98 which relation results in the slider plate 98 being in the slot 118 between the rotor 28 and the fixed base 22 blocking the return of the airpot piston 90 into the rotor 28. The slot 118 between the intermediate surface 26 of the fixed base 22 and the facing side of the rotor 28 is shown in FIGS. 7 and 8 so that the different positions that can be occupied by the slider plate 98 during the operation of the safe and arm device 10 can be easily visualized. Further, in FIG. 9 the cross-sectional view of the slider plate 98 is shown so that its retention within the fixed base 22 in a slidable manner can be understood. FIGS. 4 and 12 show the rotary switch 30 with the rotor contacts **29*a* and the switch contacts 29*b* and their relationships for the SAFE and ARMED conditions of the safe and arm device 10** respectively.

Operation:

At the moment of launch, a weapon such as a missile containing the safe and arm device 10 will have its rotor 28 as shown in FIG. 2 in such a position relative to the fixed base 22 that the safe and arm device 10 is said to be in the "SAFE" condition. In the condition shown in FIG. 2, it can be seen that the bellows 123 of the bellows motor 122 is in its unextended mode. The boss 50 extending normal to the intermediate surface 26 of the fixed base 22 extends into the channel-like receptacle 82. The nub 52 centered upon the mobile end 130 of the bellows 123 rests against the boss 50 at this time. The immobile end 126 of the bellows motor 122 is secured to the rotor 28 at the opposite end of the channel-like receptacle 82 and provides the point on the rotor from which a force can be applied against the boss 50 when the rotor 28 is freed to move. The rotor 28 is locked in the SAFE condition relative to the fixed base 22 by virtue of the airpot piston 90 of the airpot 86 extending from within the first cylindrical receptacle 62 in the fixed base 22 on one end of the extended spring 94 into the first receptacle 74 within the rotor 28 in such a way that it surrounds the detonator holder 140 holding the detonator 142 within the first receptacle 74. Thus, as shown in FIG. 6, the airpot piston 90 not only shrouds the detonator 142 in the SAFE condition, but it also, by virtue of its extending into the first receptacle 74 of the rotor 28 keeps the rotor 28 from turning relative to the fixed base 22 until the safe and arm device 10 is caused by the action of weapon acceleration acting upon the airpot 86 to transition into the ARMED condition. It should further be noted as seen in FIGS. 3 and 5, that when the rotor 28 is in the SAFE condition relative to the fixed base 22, the detent 134 acted upon by the force of spring 136 is caused to have its nub 135 extend into the shallow dimple 46. It will be observed by comparing FIGS. 2 and 3 that in the SAFE condition represented in the two figures with the detonator 142 seen in FIG. 2 shrouded and the rotor 28 held stationary and in a locked condition relative to the fixed base 22, as seen in FIG. 3, by the airpot piston 90, the detonator 142, is held 90° away from the second cylindrical receptacle 66 which contains the shaped charge 35. The shaped charge 35, as seen in FIG. 1, is used to slam the curved impact plate 36 through the window 20 a thinned area of material of the housing 14 at its base end 18, to detonate the booster charge and in turn the main warhead explosive in the warhead section of the weapon. The rotor contacts **29*a* and the switch contacts 29*b* are positioned relative to each other as shown in FIG. 4 when the safe and arm device 10 is in the SAFE condition. It should be understood that the switch contacts 29*b* are affixed to the immovable part of the rotary switch 30 which is secured to the tubular shaft 31 extending from the fixed base 22. The rotor contacts 29*a* which are fixed to the rotor 28 move with it relative to the switch contacts 29*b* when the rotor 28 is caused to move as the safe and arm device 10 transitions from the SAFE to the ARMED mode. FIG. 4 thus presents the condition of the rotary switch 30 when the safe and arm device 10** is in the SAFE mode.

The safe and arm device 10, is of course, mounted in the weapon such that the airpot 86 is subjected to the acceleration of the weapon during the ascent phase of its trajectory. As the weapon accelerates during the ascent phase of its flight, the piston 90 of the airpot 86 moves towards the base end 18 of the housing 14 within the first cylindrical receptacle 62 and compresses the airpot spring 94 as shown in FIG. 7. Simultaneously, but at a faster rate, the piston 110 within the third cylindrical receptacle 68 of the fixed base 22 compresses the spring 106 as it moves away from the slider plate 98 within the slot 118 between the fixed base 22 and the rotor 28. This faster movement of the piston 110 than the damped airpot piston 90 eliminates the friction of the slider plate 98 against airpot piston 90 prior to its translational motion.

Once the acceleration peak has been reached and the weapon begins to slow down, the piston 110 is caused by the spring 106 to move back to the left so that its cam surface 114 comes into contact with the ca surface 102 of the slider plate 98. This contact causes the slider plate 98 to move into the space 118 between the fixed base 22 and the rotor 28 so that the damped airpot piston 90 is prevented from returning to its locking position about the detonator holder 140 within the first cylindrical receptacle 74 of the rotor 28. This blocking action of the slider plate 98 results because the compressed spring 94 seen in FIG. 8 acting upon the airpot piston 90 does not cause the piston 90 to move against the resisting friction between it and the surrounding first cylindrical receptacle 62 before the piston !10 overcomes the friction between it and the surrounding third cylindrical receptacle 68. Subsequently, with the slider plate 98 accomplishing its blocking action on the piston 90 of the airpot 86, the bellows motor 122 receives an electrical signal through the leads 131 on its immobile end 126. This electrical signal detonates an explosive charge contained within the immobile end 126, the exhaust gases of which cause the bellows 123 to be expanded and extend so that the nub 52 presses against the boss 50 of the stationary fixed base 22. This action of the bellows 123 against the boss 50 results in the rotor 28 being turned 90 degrees as shown in FIG. 11 compared with the position shown in FIG. 3. The detonator 142 is thus placed directly in line with the shaped charge 35 as shown in FIG. 10. At this point the nub 135 of the detent 134 engages the deep dimple 47 within the fixed base 22 to hold the position of the rotor 28 relative to the fixed base 22 of the safe and arm device 10 so that the remaining arming action of the weapon can be completed. As shown in FIG. 12, the switch contacts **29*b* and the rotor contacts 29*a* are now in a different position compared with those shown in FIG. 4 indicating the ARMED condition of the safe and arm device 10. This permits receipt of the signal necessary to firing the detonator 142. The explosion of the detonator 142 detonates the shaped charge 35 causing the curved impact plate 36 to be forced in an explosive manner through the window 20** into the impact triggered booster charge which in turn sets off the warhead explosives in the warhead portion of the weapon.

The present invention has been described in detail in terms of the preferred embodiment. It should be understood by those skilled in the art that many variations of the invention are possible without exceeding the bounds defined by the claims which follow.

I claim:

1. An acceleration actuated safe and arm device for an external booster explosive, said device having a SAFE position and an ARMED position and, comprising:

a housing having a window at one end, and a longitudinal axis normal to said end, a means for exploding a booster explosive, a means for detonating said exploding means, a fixed base disposed at said window end of said housing and having an intermediate surface facing into said housing normal to said longitudinal axis, an elongated shaft extending normal to said surface from the center thereof and coincident with said longitudinal axis, a first cylindrical receptacle extending partially and longitudinally into said base from and normal to said intermediate surface, a second cylindrical receptacle separated angularly from said first cylindrical receptacle and extending from and normal to said intermediate surface through said base to said window to receive said exploding means, a third cylindrical receptacle separated angularly from said first and second cylindrical receptacles and extending normal from the open end in the intermediate surface of said fixed base partially therethrough, and a boss extending normal to said surface at a point radially spaced from said shaft and angularly displaced on said surface from said exploding means, said boss having at least one planar radial face, a means rotatably disposed upon said shaft in juxtaposition with said fixed base for holding said detonating means in the SAFE position of said device angularly displaced from said exploding means prior to device acceleration, and in the ARMED position of said device in direct alignment with said exploding means after the required level of device acceleration has been attained, and moving said detonating means between said SAFE and ARMED positions, an acceleration actuated means movably disposed between said fixed base and said means for holding and moving said detonating means for shrouding said detonator and locking said means for holding and moving said detonating means from rotation prior to device acceleration and, unshrouding said detonator and unlocking said means for holding and moving said detonating means for rotation at a predetermined acceleration said holding and moving means relative to said fixed base for holding said means for exploding when said device is in said SAFE or said ARMED position, respectively, and a means affixed to and extending from said means for holding and moving said detonator, to abutting relation with said planar radial face of said boss extending normal to said intermediate surface of said fixed base, for applying force to said boss and turning said means for holding and moving said detonator relative to said fixed base between said SAFE and ARMED positions.

2. The safe and arm device of claim 1 wherein said window is closed.

3. The safe and arm device of claim 2 wherein said closed window is comprised of reduced thickness housing material.

4. The safe and arm device of claim 3 wherein said means for holding and moving said detonating means upon said shaft is a rotor having a first receptacle for holding said detonating means and an angularly displaced second receptacle, each of said receptacles extending into said rotor from the direction of the intermediate surface of said fixed base.

5. The safe and arm device of claim 4 wherein said acceleration actuated means for shrouding said detonator and locking said holding and moving means from rotation, and unshrouding said detonator and unlocking said holding and moving means for rotation is an airpot.

6. The safe and arm device of claim 5 wherein said airpot is comprised of a two-sided cylinder having opposite open ends and a partition in-between, one side of said cylinder sized to movably shroud said detonator and the opposite side affixed to and accommodating one end of a compressible spring, the other end of which is affixed to the closed end of said first cylindrical receptacle in said fixed base.

7. The safe and arm device of claim 6 wherein said spring is in its extended, uncompressed condition maintaining said piston in part within said first cylindrical receptacle in said fixed base and in part within said first receptacle of said rotor for said device in its SAFE position.

8. The safe and arm device of claim 7 further comprising a means for confining said airpot piston within said first cylindrical housing when said spring is fully compressed therein by the action of acceleration upon said piston.

9. The safe and arm device of claim 8 wherein said means for confining said airpot within said first cylindrical receptacle of said fixed base, comprises:

a slider plate movably disposed between said fixed base and said rotor, said plate having a ramp-like cam surface on the side of said plate facing said first cylindrical receptacle, and a spring biased piston movably secured in said third cylindrical receptacle of said fixed base and having a cam surface at its end facing the open end of said third receptacle; said piston cam surface contacting and acting upon said mating slider plate cam surface to cause said slider plate to move over at least part of said open end of said first cylindrical receptacle when said airpot piston is totally disposed within said first cylindrical receptacle of said fixed base.

10. The safe and arm device of claim 9 wherein said means for detonating said exploding means is an electrically activated explosive detonator.

11. The safe and arm device of claim 9 wherein said means for exploding an external booster explosive comprises an explosive impact detonator.

12. The safe and arm device of claim 11 wherein said explosive impact detonator comprises a flying plate lead.

13. The safe and arm device of claim 11 wherein said explosive impact detonator comprises:

said second cylindrical receptacle having an opening at both ends;

a shaped charge disposed between the open end of said receptacle adjacent said rotor and an intermediate point therein, and a curved impact plate disposed snugly within said receptacle and intimately abutting said shaped charge at said intermediate point spaced from the other of said open ends adjoining said window.

14. The safe and arm device of claim 13 wherein the curved impact plate of said explosive impact detonator is a concave-convex surface friction fit in said receptacle against said shaped charge with the concave side of said plate facing said window.

15. The safe and arm device of claim 13 wherein said means for applying force to said boss and turning said means for holding and moving said detonator relative to said fixed base, between said SAFE and ARMED positions is a bellows motor having an immobile end affixed to said rotor and a mobile end abutting the planar face of said boss.

16. The acceleration actuated safe and arm device of claim 15 wherein said rotor further contains a channel-like receptacle extending into said rotor from the direction of the intermediate surface of said fixed base in an arcuate-like path about said fixed base shaft and diagonally opposite said first receptacle, said channel-like receptacle adapted to receive the boss, extending movably therein from said fixed base, in an abutting relationship with the mobile end of said unextended bellows motor, the immobile end of said bellows motor being affixed to one end of said channel-like receptacle.

17. The safe and arm device of claim 16 further comprising a means for holding said rotor at said SAFE and said ARMED positions.

18. The safe and arm device of claim 17 wherein said means for holding said rotor from rotation relative to said fixed base further comprises:

a pair of dimples disposed in the intermediate surface of said fixed base and angularly separated from each other, one of said dimples shallow and the other deep; and a spring biased detent having a nub extending from its free end, its opposite end secured to an elongated compressive spring, the other end of which is disposed within said second receptacle of said rotor, said nub engaging said shallow dimple in said fixed base when said device is in said SAFE position and engaging said deep dimple in said fixed base when said device is in said ARMED position.

* * * * *